US008256136B2

(12) United States Patent
Bae et al.

(10) Patent No.: US 8,256,136 B2
(45) Date of Patent: Sep. 4, 2012

(54) LAUNDRY TREATING APPARATUS

(75) Inventors: Sang Hun Bae, Changwon-si (KR); Dong Geun Lee, Changwon-si (KR); Yeon Sik Choi, Changwon-si (KR); Ju Han Yoon, Changwon-si (KR)

(73) Assignee: LG Electronics Inc., Seoul (KR)

( * ) Notice: Subject to any disclaimer, the term of this patent is extended or adjusted under 35 U.S.C. 154(b) by 833 days.

(21) Appl. No.: 12/292,143

(22) Filed: Nov. 12, 2008

(65) Prior Publication Data

US 2009/0126423 A1 May 21, 2009

(30) Foreign Application Priority Data

Nov. 21, 2007 (KR) ..... 10-2007-0119314

(51) Int. Cl.
*F26B 5/04* (2006.01)

(52) U.S. Cl. ..... 34/407; 34/485; 34/524; 34/527; 8/159; 68/53; 68/19.1

(58) Field of Classification Search ..... 34/380, 34/381, 407, 485, 497, 524, 527, 90; 8/159; 68/53, 19.1
See application file for complete search history.

(56) References Cited

U.S. PATENT DOCUMENTS 1,431,213 A * 10/1922 Braley ..... 34/233
1,786,191 A * 12/1930 Carroll ..... 34/485
2,050,625 A * 8/1936 Orr ..... 34/527
2,114,776 A * 4/1938 Davis ..... 68/18 R
2,142,042 A * 12/1938 Bowdoin et al. ..... 34/486
2,203,422 A * 6/1940 Strobridge ..... 34/527
2,217,153 A * 10/1940 Bowdoin et al. ..... 34/527
2,271,757 A * 2/1942 Boltz ..... 34/82
2,385,222 A * 9/1945 Moore ..... 34/140
2,400,726 A * 5/1946 Wright et al. ..... 118/52
2,440,416 A * 4/1948 Proudfoot ..... 34/86
2,523,305 A * 9/1950 Johnson ..... 68/53
2,524,438 A * 10/1950 Graves ..... 337/310
2,570,437 A * 10/1951 Ellis ..... 34/547
(Continued)

FOREIGN PATENT DOCUMENTS

DE 197 04 417 A1 8/1998
(Continued)

*Primary Examiner* — Stephen M. Gravini
(74) *Attorney, Agent, or Firm* — McKenna Long & Aldridge LLP

(57) ABSTRACT

A laundry treating apparatus, particularly, a laundry treating apparatus using steam is disclosed. The laundry treating apparatus such as a washing machine, a dryer, a drying and washing machine is an apparatus which washes or dries articles such as clothes. The laundry treating apparatus includes an operation course including a drying process in which hot air is supplied into a drum adapted to accommodate articles to dry the articles and a cooling process in which cool air is supplied into the drum to cool the articles, wherein the operation course further includes a steam process in which steam is supplied into the drum, and the laundry treating apparatus includes a controller which controls a heater adapted to generate the steam such that an operation time point of the heater varies according to an amount of the articles. The laundry treating apparatus includes a drum adapted to accommodate articles, a control panel adapted to provide an interface with a user, and a controller to perform a steam process for supplying steam into the drum, wherein the controller controls a heater adapted to generate the steam to perform the steam process such that an operation time point of the heater varies according to an amount of the articles.

19 Claims, 5 Drawing Sheets

U.S. PATENT DOCUMENTS

| | | | | | |
|---|---|---|---|---|---|
| 2,595,663 | A | * | 5/1952 | Howland | 34/562 |
| 2,687,578 | A | * | 8/1954 | Richterkessing | 34/127 |
| 2,717,455 | A | * | 9/1955 | Harris et al. | 34/543 |
| 2,758,461 | A | * | 8/1956 | Tann | 68/19.1 |
| 2,800,008 | A | * | 7/1957 | Raczynski | 68/19.2 |
| 2,843,944 | A | * | 7/1958 | Toma et al. | 34/75 |
| 2,864,175 | A | * | 12/1958 | Stone | 34/75 |
| 2,880,521 | A | * | 4/1959 | Gray, Jr. | 34/75 |
| 2,929,674 | A | * | 3/1960 | Tann | 8/159 |
| 2,996,809 | A | * | 8/1961 | Shapter | 34/75 |
| 3,032,887 | A | * | 5/1962 | Whyte et al. | 34/524 |
| 3,066,423 | A | * | 12/1962 | Solem | 34/86 |
| 3,102,796 | A | * | 9/1963 | Erickson | 34/75 |
| 3,121,000 | A | * | 2/1964 | Hubbard | 34/75 |
| 3,134,652 | A | * | 5/1964 | D'Angelo et al. | 34/77 |
| 3,242,584 | A | * | 3/1966 | Jacobs | 34/448 |
| 3,242,589 | A | * | 3/1966 | Jacobs | 34/595 |
| 3,256,617 | A | * | 6/1966 | Konstandt | 34/661 |
| 3,624,918 | A | * | 12/1971 | Heftler | 34/549 |
| 3,899,108 | A | * | 8/1975 | Frauendorf | 223/51 |
| 4,112,590 | A | * | 9/1978 | Muller | 34/75 |
| 4,167,594 | A | * | 9/1979 | Schwadtke et al. | 427/242 |
| 4,207,683 | A | * | 6/1980 | Horton | 34/60 |
| 4,267,643 | A | * | 5/1981 | Haried | 34/553 |
| 4,268,247 | A | * | 5/1981 | Freze | 432/21 |
| 4,326,344 | A | * | 4/1982 | Smith | 34/566 |
| 4,338,730 | A | * | 7/1982 | Tatsumi et al. | 34/569 |
| 4,370,816 | A | * | 2/1983 | Zambelli | 34/76 |
| 4,549,362 | A | * | 10/1985 | Haried | 34/395 |
| 4,763,425 | A | * | 8/1988 | Grennan | 34/552 |
| 4,811,495 | A | * | 3/1989 | Huang et al. | 34/131 |
| 5,050,313 | A | * | 9/1991 | Wakaeya et al. | 34/454 |
| 5,152,077 | A | * | 10/1992 | Liang | 34/77 |
| 5,220,813 | A | * | 6/1993 | Chen et al. | 68/3 SS |
| 5,367,787 | A | * | 11/1994 | Ikeda et al. | 34/549 |
| 5,369,892 | A | * | 12/1994 | Dhaemers | 34/275 |
| 5,443,541 | A | * | 8/1995 | St. Louis | 34/486 |
| 5,477,623 | A | * | 12/1995 | Tomizawa et al. | 34/58 |
| 5,546,678 | A | * | 8/1996 | Dhaemers | 34/275 |
| 5,555,641 | A | * | 9/1996 | Lee | 34/261 |
| 5,673,497 | A | * | 10/1997 | St. Louis | 34/486 |
| 5,730,006 | A | * | 3/1998 | Conley | 68/6 |
| 6,161,306 | A | * | 12/2000 | Clodic | 34/321 |
| 6,243,969 | B1 | * | 6/2001 | Yeazell | 34/340 |
| 6,381,870 | B1 | * | 5/2002 | Kohlman et al. | 34/311 |
| 6,434,857 | B1 | * | 8/2002 | Anderson et al. | 34/595 |
| 6,622,529 | B1 | * | 9/2003 | Crane | 68/5 C |
| 6,658,760 | B2 | * | 12/2003 | Kohlman et al. | 34/311 |
| 6,796,055 | B2 | * | 9/2004 | Baltes | 34/449 |
| 6,840,068 | B2 | * | 1/2005 | Pasin et al. | 68/5 C |
| 6,868,621 | B1 | * | 3/2005 | Grimm et al. | 34/92 |
| 6,904,703 | B2 | * | 6/2005 | Naganawa et al. | 34/596 |
| 6,941,674 | B2 | * | 9/2005 | Park et al. | 34/88 |
| 6,941,680 | B1 | * | 9/2005 | Zielewicz et al. | 34/607 |
| 7,020,982 | B2 | * | 4/2006 | Park et al. | 34/496 |
| 7,020,983 | B2 | * | 4/2006 | Bolduan et al. | 34/506 |
| 7,066,412 | B2 | * | 6/2006 | Conley et al. | 239/690 |
| 7,191,548 | B2 | * | 3/2007 | Salameh et al. | 34/380 |
| 7,213,349 | B1 | * | 5/2007 | Brunner | 34/86 |
| 7,325,330 | B2 | * | 2/2008 | Kim et al. | 34/407 |
| 7,347,005 | B2 | * | 3/2008 | Cerruti | 34/235 |
| 7,356,945 | B2 | * | 4/2008 | Choi et al. | 34/597 |
| 7,418,789 | B2 | * | 9/2008 | Choi et al. | 34/380 |
| 7,543,396 | B2 | * | 6/2009 | Nishino et al. | 34/606 |
| 7,665,227 | B2 | * | 2/2010 | Wright et al. | 34/339 |
| 7,805,856 | B2 | * | 10/2010 | Gaβmann et al. | 34/85 |
| 7,921,578 | B2 | * | 4/2011 | McAllister et al. | 34/597 |
| 7,942,025 | B1 | * | 5/2011 | Musone | 68/20 |
| 2009/0126423 | A1 | * | 5/2009 | Bae et al. | 68/5 C |

FOREIGN PATENT DOCUMENTS

| | | | | |
|---|---|---|---|---|
| EP | 1 852 541 | A1 | | 11/2007 |
| EP | 2014821 | A1 | * | 1/2009 |
| EP | 2 224 053 | A1 | | 9/2010 |
| JP | 60079254 | A | * | 5/1985 |
| JP | 60079255 | A | * | 5/1985 |
| JP | 01011597 | A | * | 1/1989 |
| JP | 02264696 | A | * | 10/1990 |
| JP | 05161797 | A | * | 6/1993 |
| JP | 06015093 | A | * | 1/1994 |
| JP | 07000689 | A | * | 1/1995 |
| JP | 07000690 | A | * | 1/1995 |
| JP | 07178292 | A | * | 7/1995 |
| JP | 09173690 | A | * | 7/1997 |
| JP | 2003326077 | A | * | 11/2003 |
| JP | 2008057816 | A | * | 3/2008 |
| JP | 2008067742 | A | * | 3/2008 |
| WO | WO 03074778 | A1 | * | 9/2003 |

* cited by examiner

LAUNDRY TREATING APPARATUS

CROSS-REFERENCE TO RELATED APPLICATION

This application claims the benefit of Korean Patent Application No. 2007-0119314, filed on Nov. 21, 2007, which is hereby incorporated by reference in its entirety as if fully set forth herein.

BACKGROUND OF THE INVENTION

1. Field of the Invention

The present invention relates to a laundry treating machine, and more particularly to a laundry treating apparatus using steam.

2. Discussion of the Related Art

A laundry treating apparatus is an apparatus which washes or dries articles such as clothes. Laundry treating apparatus include a washing machine, a dryer, a drying and washing machine, and the like.

Also, the laundry treating apparatus include a cabinet type dryer and a cabinet type refresher. These type machines include a laundry accommodating porting inside the cabinet. Therefore, a drum in a drum type laundry treating apparatus could be said as a laundry accommodating portion.

Recently, a steam generator is added to the washing machine, particularly, a drum washing machine to supply steam to the laundry, thereby improving washability and reducing energy consumption.

Meanwhile, as the quality of life is improved, a dryer for artificially drying the washed laundry instead of natural drying has been widely used.

However, since a conventional dryer is an apparatus for simply drying the articles, the dryer is required to perform additional functions in addition to drying of clothes. As for the reason, since the articles have wrinkles after the drying operation is completed, additional ironing is necessary.

Further, although the articles are not contaminated to a level required for washing, it is necessary to remove the odor and wrinkles from the articles.

Meanwhile, when the dryer performs additional functions, it is necessary for the user to easily use functions. As for the reason, even though the functions offer excellent effects and performance, if the user cannot easily use the functions, the user will use only a conventional drying function.

The laundry treating apparatus generally includes a control panel for providing an interface with the user. The user inputs various types of information to the dryer and obtains the information through the control panel.

Accordingly, it is necessary for the user to easily select the drying function and additional functions through the control panel. Further, even when the drying function and additional functions are related to each other, it is necessary for the user to easily use the laundry treating apparatus without confusion.

Further, it is necessary to control the operation of the laundry treating apparatus such that additional functions can be performed under optimum conditions, which may influence the reduction of energy consumption.

Further, it is preferable to reduce the time required to perform the additional functions. As for the reason, a total required time will increase by performing the drying function and the additional functions.

Meanwhile, the above-mentioned necessity also exists in the washing and drying machine or the washing machine as well as the dryer.

SUMMARY OF THE INVENTION

Accordingly, the present invention is directed to a laundry treating apparatus that substantially obviates one or more problems due to limitations and disadvantages of the related art.

An object of the present invention is to provide a dryer having additional functions in addition to a drying function included in a conventional dryer, thereby improving convenience in use.

Specifically, another object of the present invention is to provide a laundry treating apparatus having a crease removal function, a static electricity removal function, or an easy ironing function, thereby improving convenience in use.

Further, another object of the present invention is to provide a laundry treating apparatus capable of efficiently removing the odor and efficiently preventing a recurrence of the odor even though the laundry is left in the laundry treating apparatus for a specific period of time after the odor is removed.

Further, another object of the present invention is to provide a convenient laundry treating apparatus which enables a user to easily select a drying function and additional functions.

Further, a further object of the present invention is to provide a laundry treating apparatus capable of performing optimum additional functions and minimizing an increase in the operation time due to the additional functions. Accordingly, it is possible to provide a laundry treating apparatus capable of reducing energy consumption and allowing the user to efficiently use the time.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating apparatus comprises an operation course including a drying process in which hot air is supplied into a drum adapted to accommodate articles to dry the articles and a cooling process in which cool air is supplied into the drum to cool the articles, wherein the operation course further includes a steam process in which steam is supplied into the drum, and an operation time point of a heater adapted to generate the steam varies according to an amount of the articles.

In this case, preferably, an operation time of the heater varies according to the amount of the articles.

The steam process may be performed during the cooling process. In this case, with regard to a time period until the steam process begins after an operation of the heater is started, the operation time point of the heater may vary within a section from the last period of the drying process to an initial period of the cooling process according to the amount of the articles. Further, preferably, a time period from a start of the cooling process to an end of the steam process is invariable.

In other words, a time point at which the heater is operated to perform the steam process may vary according to the amount of the articles, but the steam process in which steam is supplied into the drum is completed after a preset period of time passes by after the cooling process begins. In this case, an end time point of the steam process may be equal to an end time point of the cooling process or may be earlier than the end time point of the cooling process. Accordingly, even though the steam process is performed, it is possible to prevent or reduce an increase in the operation time due to the steam process.

Preferably, operation conditions of the drying process vary according to dryness detected in the drying process. In this case, the amount of the articles may be determined according to the detected dryness. The operation conditions may include at least one of a drying process time, a temperature in the drum, and a capacity of a heater adapted to heat air supplied into the drum.

To achieve the above-mentioned objects of the present invention, there is provided a laundry treating apparatus comprising a drum adapted to accommodate articles, a control panel adapted to provide an interface with a user, and a controller, wherein the control panel includes: a course selection part which allows the user to select a steam-available course, which selectively includes a steam process for supplying steam into the drum, as an operation course; and an option selection part which allows the user to additionally select an option course including the steam process in the selected course, wherein if the steam-available course and the option course are selected, the controller controls a heater adapted to generate the steam such that an operation time point of the heater varies according to an amount of the articles. Further, the operation course may further include a steam course including the steam process and a steam-free course which excludes the steam process.

The option course may include a course in which the steam process is performed such that the articles have a moisture content of 5% to 6% after the drying process in which hot air is supplied into the drum to dry the articles is completed. Further, the option course may include a course in which the steam process is performed such that the articles have a moisture content of 5% or less. In this case, a target moisture content may vary according to an object to be achieved using steam.

The moisture content makes the articles uniformly damp and allows the user to easily iron the articles. Accordingly, the user can easily iron the articles through the present course. The course is simply referred to as an easy ironing course.

To achieve the above-mentioned objects of the present invention, there is provided a laundry treating apparatus comprising a drum adapted to accommodate articles, a control panel adapted to provide an interface with a user, and a controller, wherein the control panel includes: a course selection part which allows a user to select an operation course among a steam-available course which selectively includes a steam process for supplying steam into the drum, a steam course which includes the steam process, and a steam-free course which excludes the steam process, wherein the controller controls an operation of the laundry treating apparatus to perform the selected operation course.

In this case, the control panel may include an option selection part which allows the user to additionally select an option course including the steam process in the operation course.

That is, if the steam course is selected, the steam process is performed even though the option course is not selected. The steam course may include various courses according to functions and effects of the present course.

Further, if a steam-available course is selected and the option course is not selected, only the steam-available course is performed without the steam process. The steam-available course may include various courses according to functions and effects of the present course. For example, the steam-available course may include various courses for drying clothes having a low possibility of heat damage.

Further, if the steam-available course is selected and the option course is selected, the steam-available course and the option course may be performed. Further, if a steam-free course is selected, the steam-free course is performed regardless of selection of the option course, and the steam process is not performed. The steam-free course may include various courses for drying clothes having a possibility of heat damage.

Thus, the dryer according to the present invention can perform various additional functions using steam. The additional functions may be performed by selecting only the operation course or by selecting both the operation course and the option course.

The steam-available course may include a drying process in which hot air is supplied into the drum to dry the articles, and a cooling process in which cool air is supplied into the drum to cool the articles.

In this case, if the steam-available course is selected and the option course is selected, the controller controls the dryer such that the option course is performed during the drying process or the cooling process. Further, if the steam-available course is selected and the option course is selected, the controller controls the dryer such that the option course is performed after the steam-available course is completed.

Meanwhile, the option selection part may include a plurality of option courses according to the functions and purposes obtained by using steam. Only one of the plural option courses may be selected. For example, the option selection part may include a button selected to perform the option course during the steam-available course and a button selected to perform the steam process after the steam-available course is finished.

In the steam-available course, the operation may be controlled such that operation conditions of the drying process are changed according to the dryness detected during the drying process. In this case, the operation conditions may include at least one of the drying process time, the temperature in the drum, and the capacity of a heater for heating air supplied into the drum.

For example, the operation conditions may include a time required for the drying process. That is, as the articles are dried, if the dryness is higher than expected, the time required for the drying process is reduced, and if the dryness is lower than expected, the time required for the drying process is extended. Accordingly, since the optimum drying process can be performed, it is possible to prevent damage of the articles due to excessive drying or dissatisfaction of the consumer due to insufficient drying.

In this case, it is possible to determine the amount of the articles to be dried (laundry amount) using the dryness detected during the drying process. As for the reason, if the laundry amount is large, the dryness would be lower than expected, and the time required for the drying process would increase. Further, if the laundry amount is small, the dryness would be higher than expected, and the time required for the drying process would decrease. That is, the dryness detected as the drying process is performed would vary according to the laundry amount. It is possible to determine the laundry amount through the dryness.

Meanwhile, it is preferable that the heater for generating steam is operated at different time points according to the determined amount of the articles. For example, the drying process is completed at different time points according to the laundry amount, and the heater is operated at different time points according to the time point at which the drying process is completed. Further, it is preferable that the heater operation time varies according to the determined amount of the articles. In this case, the heater operation time is related to the amount of steam supplied into the drum. That is, as the heater operation time increases, the steam process time increases and the amount of supplied steam increases.

Meanwhile, the steam course may include the drying process in which hot air is supplied into the drum to dry the articles and the steam process. In the steam course, the operation may be controlled without varying the preset operation conditions of the drying process during the drying process. As for the reason, the steam course may be performed on the articles such as dry clothes or may be performed such that the articles have a certain moisture content when the course is completed. In this case, it is unnecessary or waste of energy to dry the clothes to the optimum dryness through the drying process.

Meanwhile, if the steam course is selected, preferably, the option course is inactivated not to be selected. That is, if the user selects the option course, it is possible to inform the user that the option course cannot be selected though the sound. Further, it is possible to visually inform the user that the option course cannot be selected by turning the LED off. Of course, if the above-mentioned steam-available course is selected, it is possible to inform the user that the option course can be selected by turning the LED on.

Meanwhile, the steam course may include a course in which the steam process is performed such that the articles have a moisture content of 5% to 6% after the drying process is completed. That is, when the present steam course is completed, the steam course is performed such that the articles have a moisture content of 5% to 6%. The moisture content makes the articles uniformly damp and allows the user to easily iron the articles. Accordingly, the user can easily iron the articles through the present course. The course is simply referred to as an easy ironing course.

Further, the steam course may include a course in which the drying process is performed after the steam process performed on dry articles is completed. In this case, the dry articles mean clothes which have not been washed, or articles which are not contaminated, but required to remove the odor or wrinkles. Further, the dry articles mean articles which are left in the drum for a long time after the drying process is completed and required to remove the odor or wrinkles again. Accordingly, the user can easily remove the odor or wrinkles from the clothes without washing the clothes. The course is simply referred to as a steam fresh course or a refresh course.

Meanwhile, if the steam-free course is selected, preferably, the option course is inactivated not to be selected. As for the reason, the steam-free course is provided for the articles having a possibility of heat damage due to the steam process. Accordingly, it is possible to prevent damage due to the user's error.

According to the laundry treating apparatus of the present invention, the amount of steam supplied to the articles in the steam process can be controlled to vary according to the amount of the articles. Of course, only the preset amount of steam may be supplied to the articles regardless of the amount of the articles. However, if the amount of the articles becomes larger such that the articles can have an optimum moisture content according to the function, it is preferable to increase the amount of steam.

Thus, the control panel may include a button which allows the user to select the amount of steam supplied to the articles in the steam process, or a button which allows the user to input the amount of the articles.

Meanwhile, in the steam process of the above-described laundry treating apparatus, the steam is supplied into the drum, but it is not limited thereto. That is, fine water particles and hot air instead of the steam may be supplied into the drum in the steam process.

In order to achieve the above-mentioned objects of the present invention, there is provided a laundry treating apparatus comprising a drum adapted to accommodate articles to be dried, a control panel adapted to provide an interface with a user, and a controller, wherein the control panel includes: a course selection part which allows a user to select an operation course among a steam-available course which selectively includes a steam process for supplying steam into the drum, a steam course which includes the steam process, and a steam-free course which excludes the steam process; an option selection part which allows the user to additionally select an option course including the steam process in the operation course; and a printed part provided to visually distinguish the steam-available course, the steam course and the steam-free course from each other, wherein the controller controls an operation of the laundry treating apparatus such that the selected operation course and option course are performed sequentially or simultaneously.

Further, according to the present invention, there is provided a laundry treating apparatus comprising a drum adapted to accommodate articles, a control panel adapted to provide an interface with a user, and a controller to perform a steam process for supplying steam into the drum, wherein the controller controls a heater adapted to generate the steam to perform the steam process such that an operation time point of the heater varies according to an amount of the articles.

The present invention may be realized through various embodiments, and specific matters of the embodiment may be applied to other embodiments.

According to the present invention, there is provided a laundry treating apparatus having additional functions in addition to a drying function included in a conventional dryer, thereby improving convenience in use.

Further, according to the present invention, there is provided a laundry treating apparatus having a crease removal function, a static electricity removal function, or an easy ironing function, thereby improving convenience in use.

Further, according to the present invention, there is provided a convenient laundry treating apparatus which enables a user to easily select a drying function and additional functions.

Further, according to the present invention, there is provided a laundry treating apparatus capable of performing optimum additional functions and minimizing an increase in the operation time due to the additional functions. Accordingly, it is possible to provide a laundry treating apparatus capable of reducing energy consumption and allowing the user to efficiently use the time.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
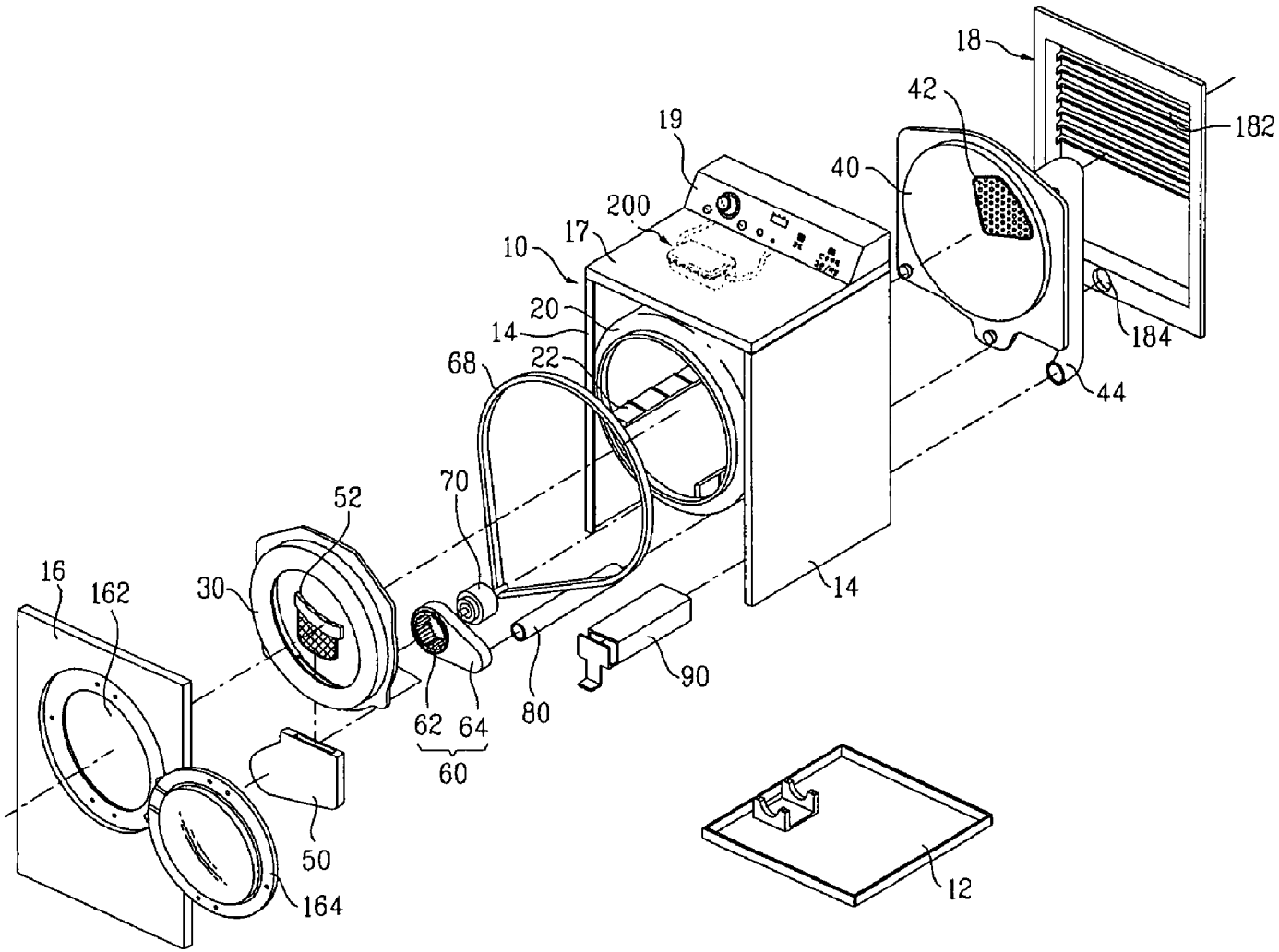
FIG. 1 illustrates an exploded perspective view of a laundry treating apparatus according to an embodiment of the present invention.
Figure 2:
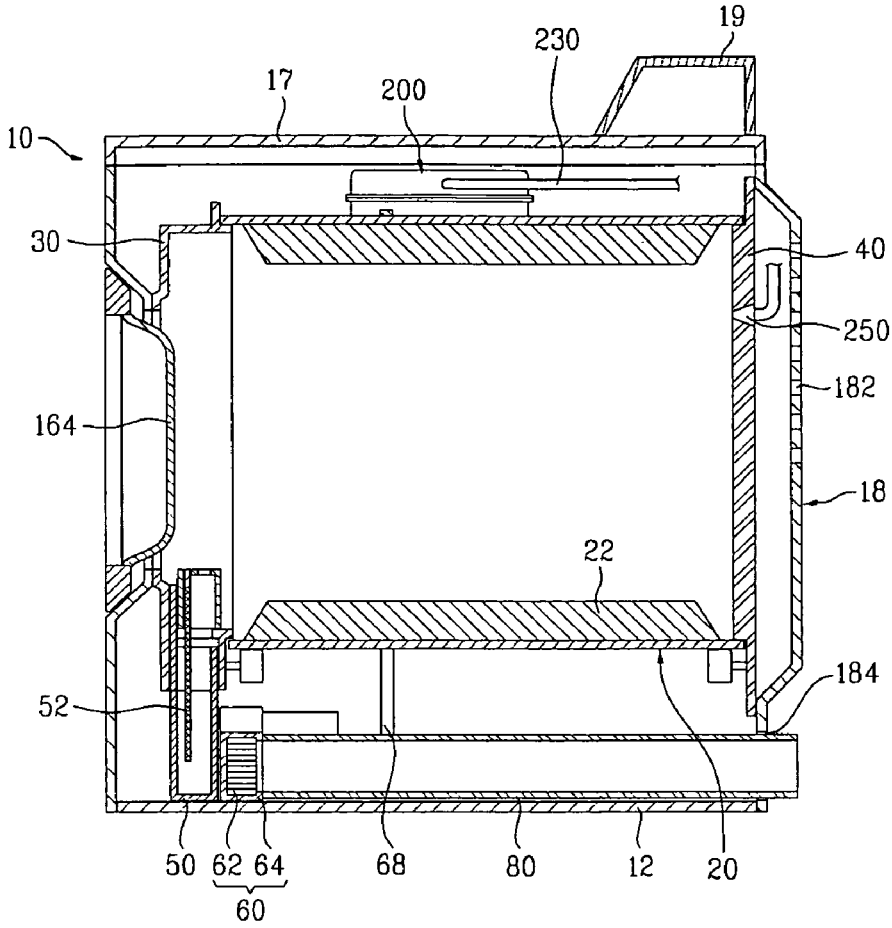
FIG. 2 illustrates a cross-sectional view of the laundry treating apparatus according to the embodiment of the present invention.

Hereinafter, a laundry treating apparatus according to an embodiment of the present invention will be described with reference to FIGS. 1 and 2. For convenience, a front-loading, electric, exhaust laundry treating apparatus is explained as an example, but the present invention is not limited thereto.

A rotatable drum 20, a motor 70 which drives the drum 20 and a belt 68 are installed inside a cabinet 10 forming an external appearance of the dryer.

Herein, the drum is the laundry accommodating portion of the dryer which accommodates laundry or articles to be dried.

Further, an air supply unit is disposed in the cabinet 10 to supply hot air or cool air into the drum 20. In this case, articles to be dried are accommodated in the drum 20.

The air supply unit includes a heater 90 (hereinafter, simply referred to as a "hot air heater") which heats air to produce high-temperature air (hereinafter, referred to as "hot air") and a hot air supply duct 44 which supplies hot air produced in the hot air heater 90 to the drum 20, all of which are disposed at specific positions of the cabinet 10. Further, the dryer includes an exhaust duct 80 which discharges humid air that has been heat-exchanged with the articles to be dried in the drum 20, and a blower unit 60 which sucks the humid air. Of course, a condensation dryer may include a condensation duct and a condenser for condensing the humid air, which has been heat-exchanged with the articles to be dried, into water.

Meanwhile, a steam generating unit is disposed at a specific position of the cabinet 10. In this case, the steam generating unit generates steam to supply the steam into the drum. The steam generating unit includes a steam generator 200 which heats water to generate high-temperature steam.

For convenience, although an indirect drive type dryer which rotates the drum 20 using the motor 70 and the belt 68 is shown and described in this embodiment, the present invention is not limited thereto. That is, a direct drive type dryer which directly rotates the drum 20 by a motor directly connected to the rear surface of the drum 20 may be applied to the present invention.

The respective components are described in detail below.

The cabinet 10 forming an external appearance of the dryer includes a base 12 forming a bottom surface, a pair of side covers 14 vertically installed on the base 12, a front cover 16 and a rear cover 18 respectively installed on the front and rear surfaces of the side covers 14, and a top cover 17 positioned at an upper portion of the side covers 14. A control panel 19 having various control switches and the like is generally disposed on the top cover 17 or the front cover 16. A door 164 is installed on the front cover 16. The rear cover 18 includes a suction port 182 which introduces outside air and an exhaust hole 184 serving as a final passage to discharge air in the drum 20 to the outside.

An inner space of the drum 20 serves as a drying chamber to perform a drying operation, and the drum 20 has a lift 22 therein.

Meanwhile, a front supporter 30 and a rear supporter 40 are installed between the drum 20 and the cabinet 10 (the front cover 16 and the rear cover 18). The drum 20 is rotatably installed between the front supporter 30 and the rear supporter 40. Sealing members (not shown) are installed between the front supporter 30 and the drum 20 and between the rear supporter 40 and the drum 20, respectively, to prevent leakage. That is, the front supporter 30 and the rear supporter 40 close the front and rear surfaces of the drum 20 to form the drying chamber and serve to support a front end and a rear end of the drum 20.

An opening is formed on the front supporter 30 such that the drum 20 communicates with the outside of the dryer. The opening is selectively opened and closed by the door 164. Further, a lint duct 50 serving as a passage for discharging air of the drum 20 to the outside is connected to the front supporter 30, and a lint filter 52 is installed in the lint duct 50. The lint duct 50 is connected to one side of the blower unit 60, and the other side of the blower unit 60 is connected to the exhaust duct 80. The exhaust duct 80 communicates with the exhaust hole 184 disposed on the rear cover 18. Accordingly, when the blower unit 60 is operated, air in the drum 20 is discharged to the outside through the lint duct 50, the exhaust duct 80 and the exhaust hole 184. In this case, foreign matter such as nap is filtered by the lint filter 52. Generally, the blower unit 60 includes a blower 62 and a blower housing 64, and the blower 62 is connected to and driven by the motor 70 for driving the drum 20.

An opening 42 generally having a number of through holes is formed on the rear supporter 40. The opening 42 is connected to the hot air supply duct 44. The hot air supply duct 44 communicates with the drum 20 to serve as a passage for supplying hot air to the drum 20. Accordingly, the hot air heater 90 is installed at a specific position of the hot air supply duct 44.

Figure 3:
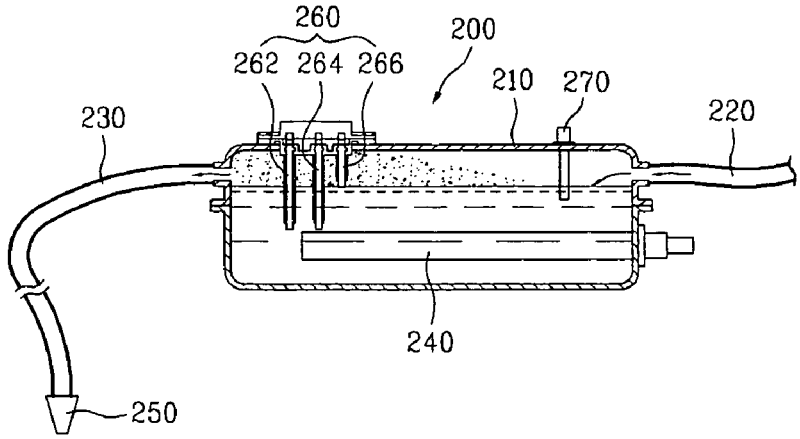
FIG. 3 illustrates a steam generator used in the laundry treating apparatus of FIG. 2.

Hereinafter, the steam generator 200 is described in detail below with reference to FIG. 3.

The steam generator 200 includes a water tank 210 for accommodating water therein, a heater 240 mounted in the water tank 210, a water level sensor 260 which measures a water level in the water tank 210, and a temperature sensor 270 which measures a temperature of water accommodated in the water tank 210.

The water level sensor 260 generally includes a common electrode 262, a low water level electrode 264 and a high water level electrode 266. The water level sensor 260 detects a high water level and a low water level according to whether the common electrode 262 is electrically connected to the high water level electrode 266 or whether the common electrode is electrically connected to the low water level electrode 264.

A water supply line 220, which is extended from a water accommodating portion to be described later to supply water, is connected to one side of the steam generator 200. A steam line 230 for discharging steam is connected to the other side of the steam generator 200. It is preferable that a nozzle 250 is installed at a leading end of the steam line 230 to increase a steam spraying efficiency.

Accordingly, according to the present invention, steam is supplied into the drum by the steam supply unit including the steam generator 200.

However, the steam generator 200 may have a different configuration. That is, the steam may be generated by heating water flowing in a pipe-shaped housing (not shown) instead of heating water accommodated in the water tank 210. For simplicity, the former refers to a container type steam generator and the latter refers to a pipe type steam generator.

Since the pipe type steam generator rapidly heats water to generate steam, it has a steam generation time shorter than that of the container type steam generator. However, in the pipe type steam generator, hot water instead of steam may be supplied into the drum. In comparison, the container type steam generator has an advantage of stably supplying steam into the drum.

In this case, the following effects can be obtained by using steam in the laundry treating apparatus.

Generally, the laundry treating apparatus performs a drying operation on the articles to be dried by hot air. As the drying operation proceeds, wrinkles or creases occur in the articles, and additional ironing is necessary after the drying operation is completed. However, the wrinkles or creases can be relieved or removed by supplying steam to the articles as the drying operation proceeds. The steam is supplied to the creases or wrinkles of the articles, and moisture of the articles is dried by hot air, thereby removing the creases. Thus, it is preferable to supply the steam to the articles after the drying operation proceeds to a certain extent.

Meanwhile, the steam has very fine particles, which are hot water particles of a few microns. Accordingly, the steam supplies moisture and high-temperature heat to the articles to be dried, thereby removing odor particles. Thus, it is possible to efficiently remove the odor by the laundry treating apparatus using steam.

Further, it is possible to supply a certain amount of moisture to the clothes through steam before the drying operation is completed. Of course, it is also possible to supply a certain amount of moisture to the clothes through steam after the drying operation is completed. The moisture is supplied all over the clothes through steam, thereby preventing displeasure of the user due to static electricity of the clothes when the user takes the clothes out of the drum.

In this case, the steam is a medium for supplying moisture and high-temperature heat to the articles to be dried. As described above, since the steam has very fine particles and a high temperature, the steam can efficiently infiltrate through the articles to be dried. Accordingly, the moisture can be uniformly absorbed into the entire articles to be dried. It is possible to efficiently prevent moisture from being excessively absorbed into only a specific portion.

Figure 4:
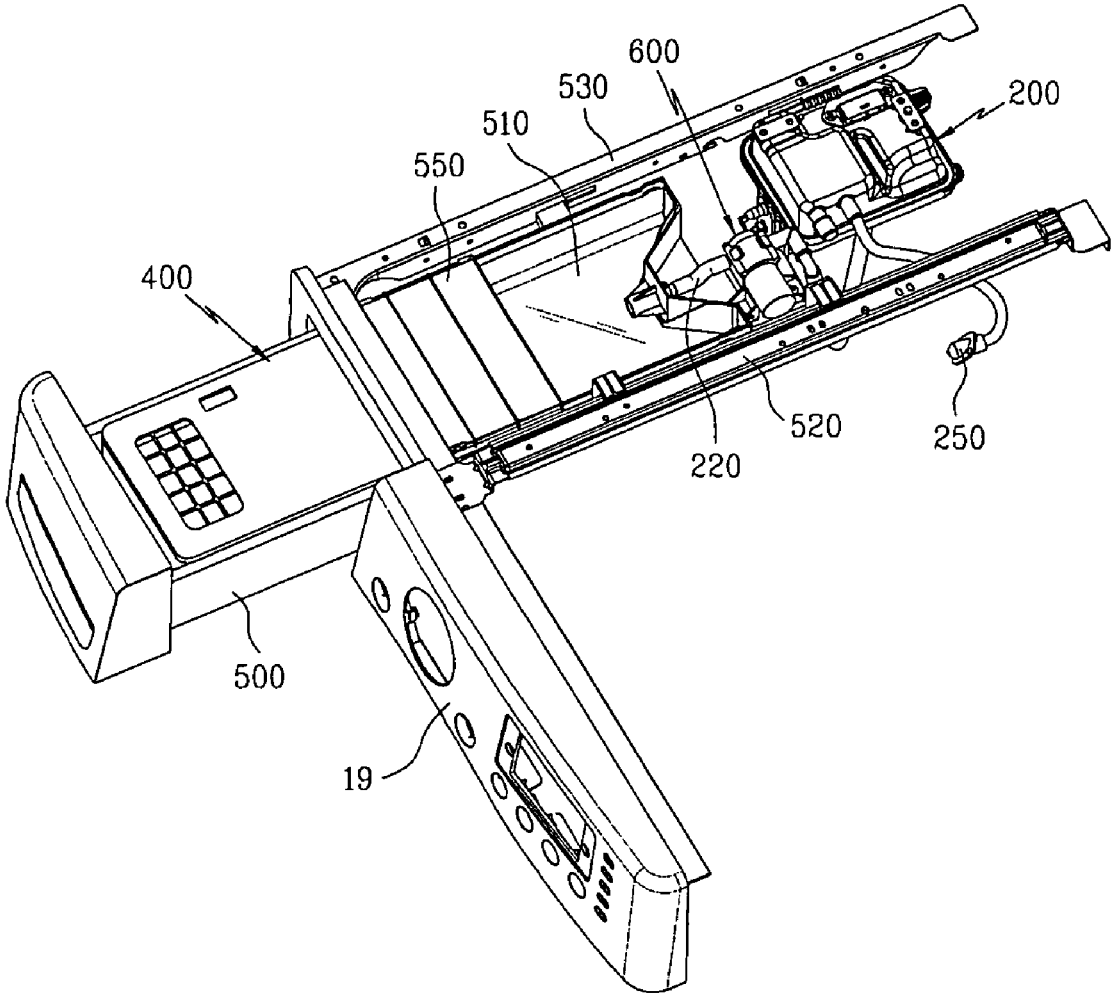
FIG. 4 illustrates a laundry treating apparatus according to another embodiment of the present invention.

FIG. 4 illustrates an embodiment in which the user directly supplies water to the steam generator 200 which is not connected to an external water supply source. In this case, the laundry treating apparatus using steam can be conveniently used in the environment lacking in facilities such as water supply equipment and drain equipment. Of course, water can be supplied into the steam generator through an external water supply as in a general laundry treating apparatus.

Hereinafter, the steam generator 200 according to the embodiment of the present invention and the structure of supplying water to the steam generator 200 will be described.

A drawer type container (hereinafter, referred to as a "drawer") 500 capable of being extracted and retracted is installed at a predetermined portion of the dryer according to the present invention. Preferably, a tank 400 is mounted in the drawer 500. In this case, the tank is a water accommodating portion for accommodating water, and the water accommodated in the water accommodating portion is supplied into the steam generator 200.

It is preferable to mount the tank 400 in the drawer 500 and to indirectly connect/disconnect the drawer 500 to/from the water supply line 220 by retracting/extracting the drawer 500, rather than to directly connect the tank 400 to the water supply line 220. As for the reason, the laundry treating apparatus uses a very small amount of water compared to the laundry treating apparatus, and the laundry treating apparatus may be used in the environment lacking in water supply equipment.

Further, the drawer 500 may be disposed on the front surface of the laundry treating apparatus, namely, the front surface of the cabinet of the laundry treating apparatus. Particularly, it is preferable that the drawer 500 is disposed on, for example, the control panel 19.

Specifically, a supporter 520 is installed at the rear of the control panel 19. That is, the supporter 520 is installed substantially parallel to a top frame 530. Preferably, a drawer guide 510 is installed on the supporter 520 and the top frame 530 to guide and support the drawer 500. More preferably, a top guide 550 is disposed at a portion of the top of the drawer guide 510.

In this case, the upper portion and one side surface (on the front surface side of the laundry treating apparatus) of the drawer guide 510 are open. The drawer 500 is extracted and retracted through the open portion.

Meanwhile, preferably, the tank 400 which supplies water to the steam generator 200 is configured to be attachable and detachable in this embodiment.

In case of using the attachable and detachable tank 400 as in this embodiment, the tank 400 is detached and supplied with water, and the tank 400 filled with water is connected to the water supply line 220 of the steam generator 200, which is very convenient.

Further, preferably, a pump 600 is disposed between the tank 400 and the steam generator 200. The pump 600 can rotate forward and backward and supply water to the steam generator 200. More preferably, the pump 600 collects residual water from the steam generator 200 as occasion demands.

Accordingly, the steam supply unit of the present invention includes the steam generator 200 which generates steam, the pump 600 which pumps water accommodated in the tank 400 to supply water to the steam generator, and the nozzle 250 which supplies the steam generated in the steam generator into the drum.

In this case, the water supply line 220 for supplying water is disposed between the tank 400 and the steam generator 200. The steam line 230 is disposed between the steam generator 200 and the nozzle 250. Further, the lines 220 and 230 may be configured as a pipe.

Further, although steam is supplied into the drum in the above embodiment, the present invention is not limited thereto.

For example, the steam generator 200 for generating steam may be omitted in the above embodiment. In this case, fine water particles may be supplied into the drum instead of the steam.

That is, when the water accommodated in the water accommodating portion 400 is pumped by the pump 600, a water pressure is generated. Accordingly, the water having a water pressure may be converted into fine water particles while passing through the nozzle 250 and, then, supplied into the drum. In this case, the nozzle 250 for supplying fine water particles may have a different shape from the above-mentioned steam nozzle. Of course, the water pressure may be a water pressure of the external water supply. That is, in a case where the external water supply is connected to the dryer, the pump 600 may be omitted. Also, in a case where the steam generator 200 is disposed in the dryer, the pump 600 may be omitted.

In this case, since the fine water particles are generated by spraying high-temperature water, the fine water particles do not have a high temperature. Further, the particles have a size of several tens of microns. Accordingly, compared to the steam, it is worrisome that the fine water particles may be supplied to only a specific portion without being uniformly supplied to the articles to be dried. Also, it is worrisome that the fine water particles may not infiltrate deeply into the articles to be dried.

In order to remove the worry, it is necessary to heat the fine water particles to a high temperature. That is, it is necessary to make the fine water particles similar to the above-mentioned steam to the maximum extent.

As described above, the air supply unit is disposed in the laundry treating apparatus to supply hot air or cool air into the drum. Accordingly, when the fine water particles are supplied into the drum, preferably, the air supply unit is operated and controlled to supply hot air into the drum. Accordingly, the fine water particles are heated and partially converted to vapor, thereby decreasing the size of the particles and increasing the temperature of the particles. Thus, the moisture can infiltrate uniformly and deeply into the articles to be dried. Further, preferably, a position of the nozzle for spraying the fine water particles is adjacent to a position of the opening 42 at which hot air is introduced into the drum in order to obtain an effective action between the fine water particles and the hot air.

That is, the spray nozzle 250 for supplying fine water particles into the drum may be disposed on the rear supporter 40 adjacent to the opening 42.

Of course, the nozzle may be positioned in the hot air supply duct 44. Accordingly, the fine water particles may be heated in the hot air supply duct and supplied into the drum together with hot air through the opening 42.

Hereinafter, the control panel 19 for providing an interface with the user will be described with reference to FIG. 5.

The control panel 19 includes a course selection part 610, a power button 620 and a start button 621. The user can select a desired operation course among a plurality of courses through the course selection part 610.

The course selection part 610 includes a steam course 613, a steam-available course 611 and a steam-free course 612. Each course may include a plurality of courses. In this case, the steam course 613 is a course which includes a steam process in which steam is supplied into the drum. The steam-available course 611 is a course which selectively includes the steam process. The steam-free course 612 is a course which excludes the steam process.

Accordingly, if a desired course is selected through the course selection part 610, the controller controls the operation of the laundry treating apparatus according to the selected course.

Further, the control panel 19 may include an option selection part 630 which allows the user to additionally select an option course including the steam process in the operation course.

Further, the control panel 19 includes a printed part 614 having various shapes, which includes letters printed on the respective buttons, letters printed around the course selection part 610 and the like. The user can perceive a course or an option to be inputted through the printed part. Further, as will be described later, the user can easily perceive whether each course includes the steam process or selectively includes the steam process, whether dryness is detected to perform an optimum drying operation or an additional function, or the like.

Hereinafter, a drying function and additional functions provided in the laundry treating apparatus according to the present invention that are selected and controlled through the control panel shown in FIG. 5 will be described in detail.

The user can select the steam-available course 611 through the course selection part 610. In this case, the steam-available course is a course which selectively includes the steam process. The user can select the steam process through the option selection part 630.

For example, the steam-available course 611 may include various courses according to the type of clothes having a low possibility of heat damage. The steam-available course 611 may include a general drying course, a course for drying cotton or a towel, and a course for jeans required to be dried for a long period of time.

Since the steam-available course 611 is a course for drying the clothes having a low possibility of heat damage, the steam-available course 611 includes a drying process in which hot air is supplied into the drum to dry target articles and a cooling process in which cool air is supplied into the drum to cool the target articles. In this case, since the inside of the drum and the articles have a high temperature when the course is completed, the cooling process prevents the user from being hurt due to the high temperature. However, if the temperature of hot air is lowered in the last period of the drying process, the cooling process may be omitted.

Meanwhile, if the steam-available course 611 and the option course 630 are selected, the controller may control the dryer to perform the option course in the drying process or the cooling process. Further, the controller may control the dryer to perform the option course after the steam-available course is completed.

For example, a case where the steam-available course 611 is a general drying course (NORMAL) and the option course 630 is a static electricity removal course 632 (STATIC CARE) is explained below.

Figure 5:
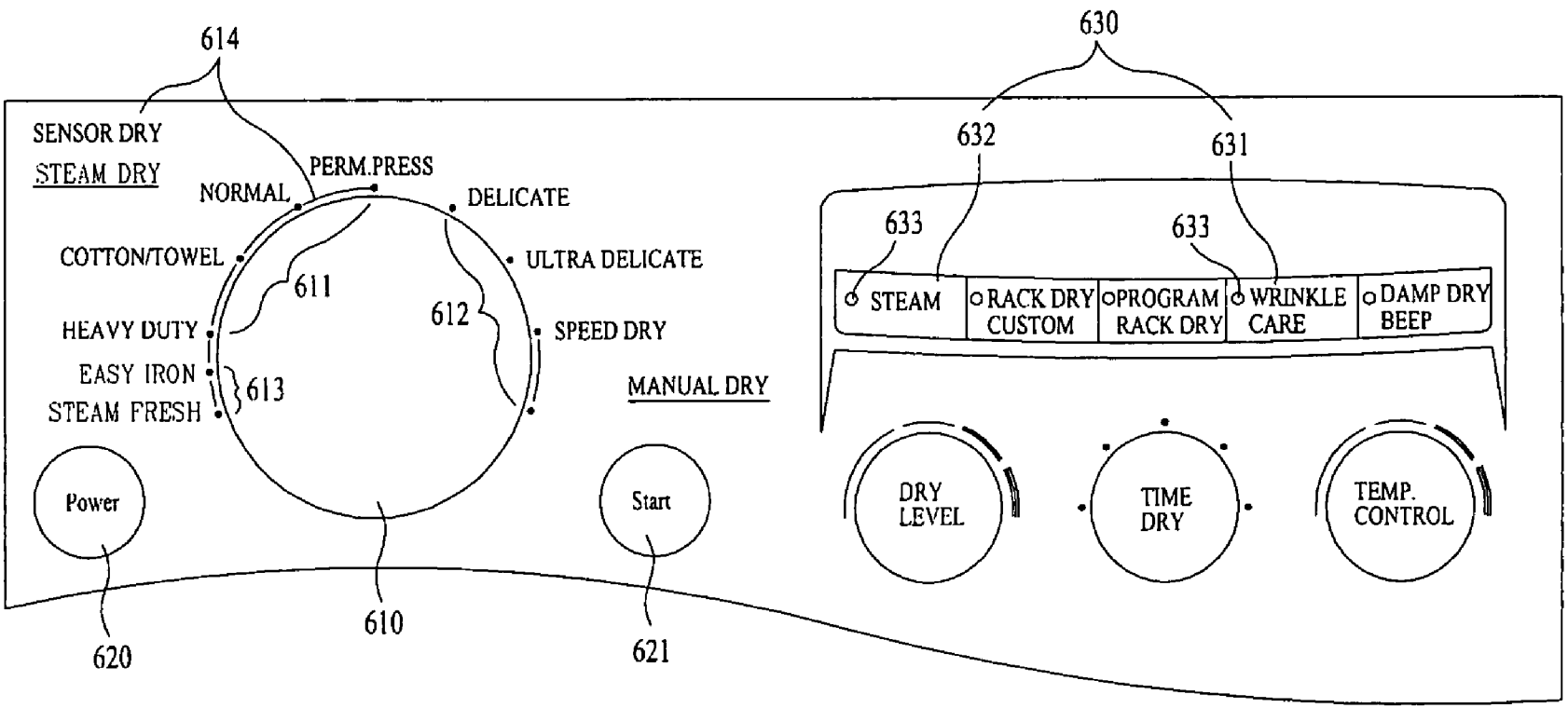
FIG. 5 illustrates a control panel of the laundry treating apparatus of FIG. 1.

The static electricity removal course is represented by STEAM in FIG. 5. Thus, the STEAM button may be provided for another option course other than the static electricity removal course.

If only the steam-available course is selected, static electricity is generated in the dried articles after the course is completed, thereby causing displeasure to the user. Accordingly, the static electricity removal course may be selected to remove the static electricity.

In order to remove the static electricity, it is necessary to supply the steam to the articles such that the articles have a certain moisture content. Accordingly, it is preferable to carry out the steam process after the drying process is completed. Further, the steam process may be performed during the cooling process and may be performed after the cooling process is completed. That is, the articles dried through the drying process have a certain moisture content through the steam process during or after the cooling process, thereby minimizing displeasure of the user due to the static electricity.

In this case, it is preferable to control the amount of steam supplied to the articles to remove or reduce the static electricity. As for the reason, since an excessive amount of steam makes the articles too wet, it may be necessary to redry the articles. Thus, it is preferable to control the amount of steam such that the articles have a moisture content less than 5%.

A case where the steam-available course 611 is a cotton/towel course (COTTON/TOWEL) and the option course 630 is a wrinkle removal course 631 (WRINKLE CARE) is explained below.

In this case, the steam process may be performed in the last period of the drying process. That is, the articles are dried through the drying process and the steam process is performed to uniformly supply steam to the articles. Thereafter, the drying process continuously proceeds to remove the wrinkles. Of course, the drying process is completed and the steam process may be performed. In this case, after the steam process is completed, the drying process may be resumed.

Meanwhile, it is preferable to perform the drying process after the steam process in the wrinkle removal course 631. As for the reason, in order to remove the wrinkles, it is necessary to supply a larger amount of steam than the amount of steam supplied to the articles to remove the static electricity as described above. Accordingly, it is necessary to dry the articles through the drying process after the steam process. In this case, the wrinkle removal effect can be improved through hot air.

In this case, the option course 630 may be repeatedly selected. For example, either or both of the static electricity removal course 632 and the wrinkle removal course 631 may be selected. In this case, the steam process may be performed several times. Of course, the steam process is performed at a different time point to obtain each function.

Further, the option course 630 may be selected by pressing a button. That is, a specific option course may be selected by repeatedly pressing a single button, or respective buttons may be provided according to respective option courses. Accordingly, the option course may proceed during the steam-available course by pressing a specific button, or the option course may proceed after the steam-available course by pressing another specific button.

It is preferable to control the operation such that the steam-available course 611 is performed by varying the operation conditions of the drying process according to the dryness detected in the drying process, which is simply referred to as "SENSOR DRY." That is, the dryness is detected during the drying process to achieve the optimum drying effect. Thus, it is possible to prevent excessive drying or insufficient drying.

Although not shown in the drawings, the dryness may be detected by a humidity sensor provided on the door. The humidity sensor is an electrode sensor capable of detecting the dryness through a voltage or current value generated when the articles are in contact with the electrode sensor. Since the detection of the dryness using the electrode sensor is apparent to those skilled in the art, the detailed description thereof is omitted.

For example, in case where an expected time of the drying process is 50 minutes at the beginning, a remaining time of the drying process is reduced if the articles are more dried than expected as the drying process proceeds, and the remaining time is extended if the articles are less dried than expected. Further, in addition to the time of the drying process, the capacity of the heater for generating hot air may be changed. Of course, a preset temperature in the drum for determining whether hot air is supplied or not may be also changed.

Meanwhile, the amount of the articles, that is, a laundry amount, may be determined according to the dryness detected during the drying process. The present course is a course for drying wet clothes after a washing operation. Accordingly, if the laundry amount is large, the drying process would be performed for a long period of time. That is, as time goes by, the clothes are slowly dried if the laundry amount is large, and the clothes are quickly dried if the laundry amount is small. Accordingly, it is possible to determine the laundry amount using this fact.

The steam course 613 includes the drying process for supplying hot air into the drum to dry the articles and the steam process. That is, if the steam course 613 is selected, the drying process is automatically performed. In the present course, the operation is controlled through the steam process according to the preset program, thereby obtaining an optimum additional function in addition to a simple drying function. Accordingly, if the steam course 613 is selected, it is preferable that the option course cannot be selected. That is, it is preferable to inactivate the option selection part 630.

The steam course 613 may include an easy ironing course (EASY IRON). In this course, the steam process may be performed such that the articles have a moisture content of 5% to 6% after the drying process is completed. Accordingly, after the course is completed, the clothes contain moisture to facilitate ironing.

Further, the steam course 613 may include a refresh course or a steam fresh course (STEAM FRESH). The steam fresh course is characterized to be performed on dry articles. That is, the steam fresh course may be performed to easily remove the odor or dust from dry clothes. Accordingly, the drying process may be omitted in an initial period of the present course. However, a process for supplying hot air or cool air into the drum may be included in the present course to remove dust. Further, the steam process is performed in the present course, and high-temperature steam is supplied to the articles to efficiently remove wrinkles and the odor. Further, it is possible to provide well-dried clothes by reviving strands of clothes. In the present course, it is preferable to supply steam such that the articles have a moisture content equal to or larger than 6% to remove the odor and wrinkles. Accordingly, it is preferable that the drying process for drying the articles is performed after the steam process. As for the reason, an object of the present course is to process dry clothes such that the user can wear the clothes immediately. However, since the drying process is performed to remove a small amount of moisture, preferably, the drying process is controlled to be performed for only a short period of time.

As described above, the steam course has a basic object to process dry articles, not to completely dry the articles. Accordingly, in the steam course, it is preferable that the drying process is performed according to a program which is set in advance in an initial period of the operation or a preset program. That is, it is preferable to control the operation such that the drying process is performed without varying the preset operation conditions of the drying process. For example, since it is preferable that the steam fresh course is performed for a short period of time, it is not preferable that the time required for the course is variable. Further, detection of dryness may cause unnecessary energy consumption.

The steam-free course 612 is a course which does not include the steam process and does not allow selection of the steam process. That is, the steam-free course 612 is a course for delicate clothes having a possibility of heat damage. In the same way, if the steam-free course is selected, preferably, the controller controls the dryer that the user cannot select the option course including the steam process.

As shown in FIG. 5, the control panel 19 of the laundry treating apparatus according to the present invention may include the printed part 614 formed in various shapes.

In a case where the course selection part 610 is formed in a rotary knob shape, the user can select a desired course by rotating the rotary knob. As described above, the laundry treating apparatus according to the present invention includes various courses according to whether the steam process is included or available.

For example, the courses in which the steam process is included or available are disposed on the left of the course selection part 610. The courses in which the steam process is excluded may be disposed on the right of the course selection part 610. Letters "STEAM DRY" may be printed on the left of the course selection part to allow the user to easily perceive the fact. Further, the letters "STEAM DRY" may be printed in a specific color, and the corresponding courses may be displayed by printing an arc in the same color as the specific color as shown in FIG. 5. Accordingly, when the user selects the course printed in a specific color or represented with an arc, the user can easily perceive whether the steam is used or available in the course.

Meanwhile, it is preferable to surely distinguish the steam course from the steam-available course. Accordingly, for this, the steam-available course and the steam course may have letters printed in different colors. For example, the steam-available course may have the letters printed in black and the steam course may have the letters printed in red. Further, the letters "STEAM DRY" may be printed and underlined in red. Accordingly, the user can easily distinguish the steam course from the steam-available course through the above-described printed part. In other words, the user can clearly perceive that the courses having the red arc and the black letters are included in the steam-available course and the courses having the red arc and the red letters are included in the steam course.

Further, there are a sensing and drying course in which the dryness is detected to vary the operation conditions during the course as described above, and a non-sensing and drying course in which the dryness is not detected. Accordingly, as shown in FIG. 5, sensing and drying courses can be displayed with letters "SENSOR DRY" and printed with letters in the same color as the letters "SENSOR DRY." That is, the letters "SENSOR DRY" may be printed in black and the respective sensing and drying courses may be printed with letters in black. Accordingly, the user can easily perceive that the courses having black letters are sensing and drying courses.

Thus, the user can select various types of operation courses and also clearly perceive the features of the respective operation courses through the printed part 614 having various shapes capable of being visually distinguished. Further, the user can clearly perceive whether the option course 630 related to the steam process can be selected through the printed part 614. Thus, the user can easily use the dryer and it is very easy to utilize a drying function and various additional functions.

Meanwhile, although not shown in FIG. 5, a button which allows the user to select the amount of the articles may be provided. Further, a button which allows the user to select the supply amount of steam may be provided. Both or either of the buttons may be provided. When either of the buttons is provided, if the user selects a large amount of the articles, the controller may increase the supply amount of steam in the steam process in response thereto.

Further, LEDs 633 may be provided on the option selection part 630. For example, the LEDs may be provided on the option course buttons 631 and 632, respectively. In this case, the LEDs in a twinkling state may be lighted when the buttons are selected. On the other hand, the LEDs in a lighted state may twinkle when the buttons are selected. Of course, after the LEDs are lighted, the LEDs may be turned off when they are selected. That is, the LEDs may be configured to have different states before and after the selection. Accordingly, preferably, the states of the LEDs may be visually displayed for the user.

In this case, as described above, the option course buttons 631 and 632 can be selected when the steam-available course 611 is selected. Thus, if the steam-available course is selected, it is preferable that the LEDs are lighted or twinkling to notify the user that the option course can be selected. Of course, when the steam-free course is selected, it is preferable that the LEDs are turned off to notify the user that the option course cannot be selected.

Hereinafter, the steam process performed in the laundry treating apparatus according to the present invention will be described in detail with reference to FIGS. 6 and 7.

For example, a case where a general drying course (NORMAL) of the steam-available course 611 and a static electricity removal course (STATIC CARE) of the option course 630 are selected is explained below.

Figure 6:
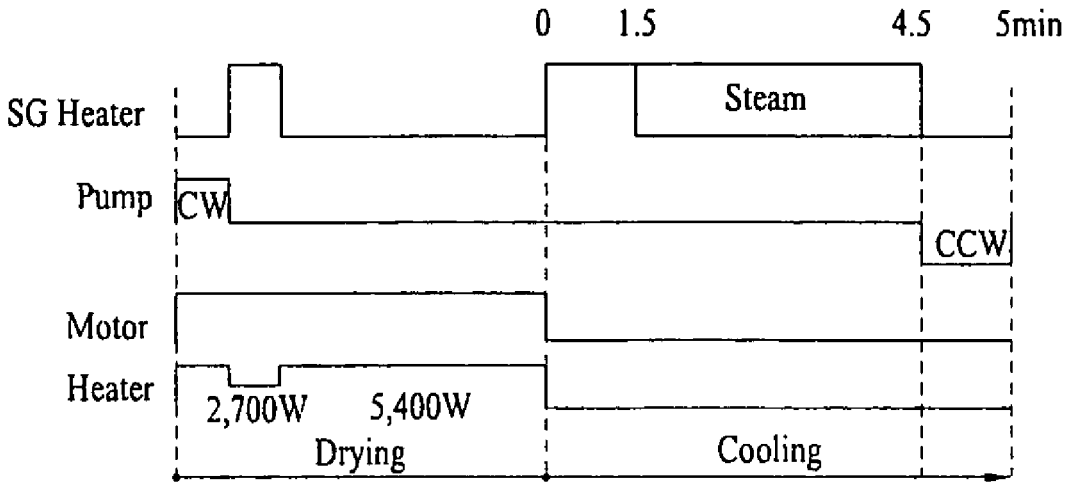
FIG. 6 is an operation flowchart in a small laundry amount in the laundry treating apparatus according to the embodiment of the present invention.
Figure 7:
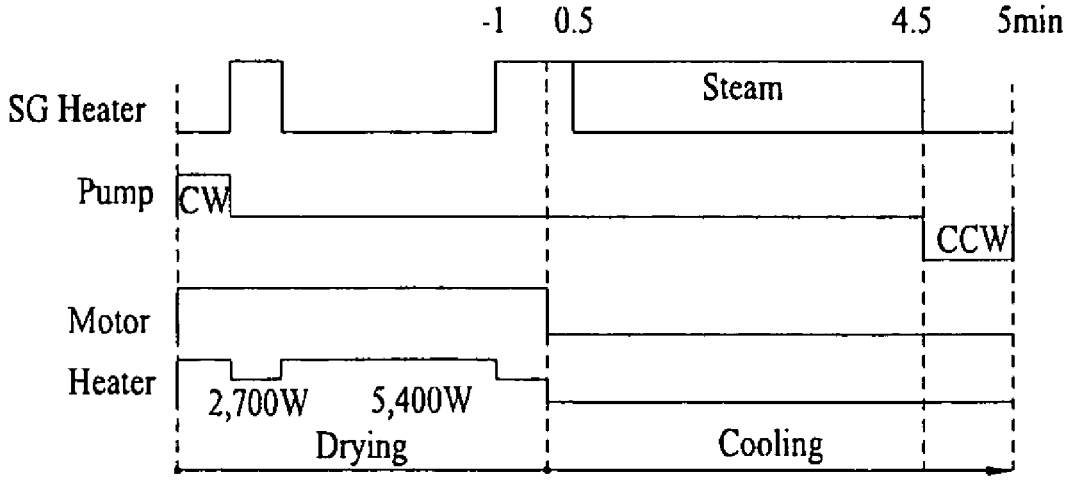
FIG. 7 is an operation flowchart in a large laundry amount in the laundry treating apparatus according to the embodiment of the present invention.

First, as shown in FIGS. 6 and 7, the general drying course includes the drying process and the cooling process. That is, the articles are dried through the drying process and cooled through the cooling process. Flowcharts shown in FIGS. 6 and 7 are different in the laundry amount. For example, the laundry amount is 1 kg in an example shown in FIG. 6, and the laundry amount is 3 kg in an example shown in FIG. 7. However, the examples of FIGS. 6 and 7 are not necessarily related to specific laundry amounts and are examples for explaining a difference according to an increase in the laundry amount.

In this case, as described above, the sensing and drying course may be performed in the general drying course. In other words, in order to perform an optimum drying process, the dryness is detected as the drying process proceeds and an operation time required for the drying process or the like may be changed. For example, if the drying process time is set to be 50 minutes in advance in an initial period of the operation, the drying process time may be changed to 40 minutes as shown in FIG. 6 or to 60 minutes as shown in FIG. 7 as the drying process proceeds. It is determined whether more drying time is necessary or not through the dryness detected by the controller.

In this case, the dryness would vary according to the laundry amount. For example, if the laundry amount is large, the longer time than the preset time is required for the drying process, whereas if the laundry amount is small, the shorter time is required for the drying process. Accordingly, the laundry amount may be determined by detecting the dryness. Of course, if the drying process is completed through the sensing and drying course, the optimum drying process can be achieved.

Meanwhile, the static electricity removal course is provided for the purpose of preventing displeasure of the user due to static electricity when the user takes the articles out of the drum after the drying process is completed. Accordingly, it is preferable to supply a specific amount of moisture to the articles after the drying process. In this case, since the drying process is performed through the sensing and drying course, the articles are in a dried state regardless of the laundry amount.

In this case, preferably, the amount of steam for removing static electricity is changed according to the laundry amount. That is, preferably, a small amount of steam is supplied in a small laundry amount and a large amount of steam is supplied in a large laundry amount. In other words, it is preferable that steam is supplied to the articles such that the articles have a moisture content of 5% or less regardless of the laundry amount. If the moisture content is large, although the static electricity can be removed, the articles may be damp. In this case, the steam for removing static electricity may not be supplied directly to the articles. That is, if the atmosphere in the drum has a certain amount of moisture, it is possible to obtain an static electricity removal effect.

In the general drying course, the cooling process is performed after the drying process. The cooling process may be performed for a preset period of time regardless of the laundry amount. The cooling process time may increase according to the laundry amount. However, if the cooling process is performed in order to mainly cool the articles, not to dry the articles, it is preferable that the cooling process is performed for only a preset period of time regardless of the laundry amount. For example, the cooling process may be performed for 5 minutes regardless of the laundry amount as shown in FIGS. 6 and 7.

Preferably, the steam process for removing static electricity is performed in the cooling process. Accordingly, it is possible to prevent an increase in the total operation time due to an addition of the steam process or to minimize the operation time. That is, in a case where the cooling process is performed for 5 minutes, if the steam process is completed before the cooling process is completed, it is possible to prevent an increase in the operation time due to the steam process.

Accordingly, in order to prevent an increase in the operation time due to the steam process and to efficiently remove static electricity, it is preferable that an operation time point of the heater 240 for generating steam varies according to the amount of the articles.

As shown in FIG. 6, if it is detected that the laundry amount is 1 kg through the dryness detected during the drying process, the heater 240 may be controlled to be operated at the same time when the cooling process begins. In this case, if a specific period of time passes by after the heater is operated, steam is supplied into the drum. As for the reason, a specific period of time is required until water is heated to generate steam according to the amount of heated water and the capacity of the heater. Of course, although the specific period of time is also required in the above-described pipe type steam generator, a shorter time is required in the pipe type steam generator than the time required in the container type steam generator.

FIG. 6 illustrates a case where the steam process begins after about 1.5 minutes since an operation of the heater is started. Accordingly, in this case, the steam process is performed for about 3 or 3.5 minutes. Of course, since the steam process is performed in the cooling process performed for a preset time of 5 minutes, there is no increase in the operation time due to the steam process.

As shown in FIG. 7, if the laundry amount of 3 kg is detected through the dryness detected during the drying process, the heater 240 may be controlled to be operated at 1 minute before the end of the drying process. Further, in the drying process in which the heater is operated, preferably, the heater for generating hot air is controlled to have a small capacity. As for the reason, it is preferable that instantaneous power consumption of the entire laundry treating apparatus is equal to or smaller than a predetermined value.

Meanwhile, as described above, since the steam process is performed after 1.5 minutes from the time when the heater 240 is operated, the steam process is performed in the cooling process. Also in this case, there is no increase in the operation time due to the steam process. Further, in this case, since the steam process begins after about 0.5 minute from the time when the cooling process is started, the steam process is performed for about 4 or 4.5 minutes. Accordingly, the steam process time becomes longer compared to the case of the laundry amount of 1 kg. That is, the operation time of the heater 240 becomes longer, thereby increasing the amount of steam supplied into the drum.

Thus, in the laundry treating apparatus according to the present invention, with regard to a time period (e.g., 1.5 minutes) until the steam process begins after the operation of the heater 240 is started, it is preferable to control the operation time point of the heater to vary according to the laundry amount. Further, preferably, the operation time point of the heater varies within a section from the last period of the drying process to an initial period of the cooling process. In this case, it is preferable that the steam process is performed in the cooling process. However, the steam process may be performed even during the drying process, or a part of the steam process may be performed for a certain period of time before the cooling process after the drying process. Thus, it is possible to prevent an increase in the total operation time due to the steam process or to minimize the operation time by controlling the operation time point of the heater.

Meanwhile, although not shown in the drawings, the operation time point of the heater may be 1.5 minutes before the end of the drying process. In this case, the steam process may be performed in the entire section of the cooling process performed for 5 minutes, which may be the most effective way to remove static electricity in the maximum laundry amount. Accordingly, with regard to the capacity of the steam generator or the laundry amount, an optimum amount of steam or a time required for the steam process may be experimentally determined.

As shown in FIGS. 6 and 7, if the laundry amount is 1 kg, the motor is not driven in the cooling process, and if the laundry amount is 3 kg, the motor is driven. In this case, the motor drives the drum and a fan for supplying air into the drum at the same time. Accordingly, if the motor is driven, the drum is driven and air (cool air because of the cooling process) is introduced into the drum.

In this case, the motor is selectively driven according to the laundry amount for the following reason. In a case of a small laundry amount, if the motor is driven, since a small amount of steam is supplied into the drum, the steam may be discharged from the drum without influencing the articles or the atmosphere in the drum. Accordingly, in this case, it is preferable that the motor is not driven. On the other hand, in a case of a large laundry amount, since a large amount of steam is supplied into the drum, although the steam is discharged from the drum, it is possible to efficiently supply steam to the articles.

Thus, when the laundry amount is classified into small, middle and large laundry amounts, it is preferable that the motor is not driven in the small laundry amount in the cooling process. Of course, in this case, it is more preferable that the motor is not driven only while the steam process is performed in the cooling process.

Further, if the laundry amount is further classified into various laundry amounts, the motor may be controlled not to be driven in a laundry amount equal to or smaller than a specific laundry amount. The specific laundry amount may be experimentally determined.

However, in a different way from the above description, if a motor for driving the drum and a motor for supplying air are separately provided, the drum is driven in any case, and only the motor for supplying air may be selectively driven.

Meanwhile, as shown in FIGS. 6 and 7, if the selected course or the option course includes the drying process and the steam process, it is preferable to preheat the heater 240 in an initial period of the drying process. Accordingly, it is also possible to prevent an increase in the operation time due to the steam process. Further, the preheating may be performed to heat water to a temperature, for example, 80° C., at which steam is not generated. In this case, it is possible to minimize a time difference from the operation of the heater to the start of the steam process, which is generated due to an initial temperature of water. In other words, it is possible to accurately control the amount of steam.

Further, the preheating is effective also in the pipe type steam generator. That is, it is possible to prevent heated water instead of steam from being supplied into the drum in an initial period of the steam process.

The pump 600 shown in FIG. 4 supplies water to the steam generator. If the pump 600 is driven clockwise, the pump supplies water to the steam generator, and if the pump 600 is driven counterclockwise, the pump collects remaining water from the steam generator.

Meanwhile, in the above embodiment, the operation time point of the heater 240 is changed according to the laundry amount determined through the detected dryness. However, the laundry amount may be a laundry amount inputted by the user or a laundry amount detected by another method. Further, a range of the amount of steam or a range of the operation time of the heater 240, which may vary according to the laundry amount, may become larger or smaller than the above embodiment. It may vary according to additional functions to be obtained using steam.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A controlling method for a laundry treating apparatus comprising:

an operation course including a drying process in which hot air is supplied into a laundry accommodating portion adapted to accommodate articles to dry the articles and a cooling process to cool the articles, wherein the operation course further includes a steam process in which steam is supplied into the laundry accommodating portion, wherein the controlling method includes controlling a heater adapted to generate the steam such that an operation start time point of the heater is earlier as an amount of the articles in the laundry accommodating portion is more, and wherein the operation start time point of the heater is in either the drying process or the cooling process.

2. The controlling method according to claim 1, wherein the steam process is performed during the cooling process.

3. The controlling method according to claim 2, wherein with regard to a time period until the steam process begins after an operation of the heater is started, the operation start time point of the heater varies within a section from the last period of the drying process to an initial period of the cooling process according to the amount of the articles.

4. The controlling method according to claim 2, wherein a time period from a start of the cooling process to an end of the steam process is invariable.

5. The controlling method according to claim 1, wherein operation conditions of the drying process vary according to dryness detected in the drying process.

6. The controlling method according to claim 5, wherein the amount of the articles is determined according to the detected dryness.

7. The controlling method according to claim 5, wherein the operation conditions include at least one of a drying process time, a temperature in the laundry accommodating portion, and a capacity of a heater adapted to heat air supplied into the laundry accommodating portion.

8. The controlling method according to claim 1, wherein fine water particles and hot air are supplied into the laundry accommodating portion instead of the steam in the steam process, and the operation start time point of the heater is replaced by a time point at which the fine water particles and the hot air are supplied into the laundry accommodating portion.

9. A controlling method for a laundry treating apparatus comprising a laundry accommodating portion adapted to accommodate articles, a control panel adapted to provide an interface with a user, and a controller, wherein the control panel includes:

a course selection part which allows the user to select a steam-available course, which selectively includes a steam process for supplying steam into the laundry accommodating portion, as an operation course; and an option selection part which allows the user to additionally select an option course including the steam process in the selected course, the controlling method comprising:

controlling a heater adapted to generate the steam when the steam-available course and the option course are selected such that an operation start time point of the heater is earlier as an amount of the articles in the laundry accommodating portion is more, and wherein the heater is turned on during the steam-available course.

10. The controlling method according to claim 9, wherein the steam-available course includes a drying process in which hot air is supplied into the laundry accommodating portion to dry the articles and a cooling process to cool the articles.

11. The controlling method according to claim 9, wherein the steam process is performed during the cooling process.

12. The controlling method according to claim 11, wherein with regard to a time period until the steam process begins after an operation of the heater is started, the operation start time point of the heater varies within a section from the last period of the drying process to an initial period of the cooling process according to the amount of the articles.

13. The controlling method according to claim 9, wherein the operation start time point of the heater varies according to the amount of the articles.

14. The controlling method apparatus according to claim 9, wherein the option course includes a course in which the steam process is performed such that the articles have a moisture content of 5% or less after the drying process is completed.

15. The controlling method according to claim 9, wherein the steam-available course includes a drying process in which hot air is supplied into the laundry accommodating porting to dry the articles, and the option course includes a cooling process to cool the articles and the steam process.

16. The controlling method according to claim 15, wherein the steam process is performed during the cooling process.

17. The controlling method according to claim 16, wherein with regard to a time period until the steam process begins after an operation of the heater is started, the operation start time point of the heater varies within a section from the last period of the drying process to an initial period of the cooling process according to the amount of the articles.

18. The controlling method according to claim 17, wherein when the amount of the articles is determined to be equal to or smaller than a specific amount, the laundry accommodating portion, which is rotatably disposed in a cabinet as a drum, is not driven during the cooling process.

19. The controlling method according to claim 9, wherein fine water particles and hot air are supplied into the laundry accommodating portion instead of the steam in the steam process, and the operation start time point of the heater is replaced by a time point at which the fine water particles and the hot air are supplied into the laundry accommodating portion.

* * * * *